US010413013B1

(12) United States Patent
Corona

(10) Patent No.: US 10,413,013 B1
(45) Date of Patent: Sep. 17, 2019

(54) WRAPPED FOOTWEAR AND METHOD OF WRAPPING

(71) Applicant: Angelina Bella Corona, Redmond, WA (US)

(72) Inventor: Angelina Bella Corona, Redmond, WA (US)

( * ) Notice: Subject to any disclaimer, the term of this patent is extended or adjusted under 35 U.S.C. 154(b) by 260 days.

(21) Appl. No.: 15/009,204

(22) Filed: Jan. 28, 2016

Related U.S. Application Data

(60) Provisional application No. 62/115,132, filed on Feb. 11, 2015.

(51) Int. Cl.
*A43B 3/12* (2006.01)

(52) U.S. Cl.
CPC ..... *A43B 3/122* (2013.01); *A43B 3/12* (2013.01); *A43B 3/126* (2013.01)

(58) Field of Classification Search
CPC ..... A43B 3/12; A43B 3/122; A43B 3/126
See application file for complete search history.

(56) References Cited

U.S. PATENT DOCUMENTS

| | | | | | |
|---|---|---|---|---|---|
| 2,390,685 | A * | 12/1945 | Benson | A43B 3/105 | 36/11.5 |
| 4,920,664 | A * | 5/1990 | McGregor | A43B 3/126 | 36/11.5 |
| 5,423,134 | A * | 6/1995 | Bagnaia | A43B 3/128 | 36/101 |
| 7,854,638 | B2 * | 12/2010 | Twombly | A63B 31/11 | 441/64 |
| D694,995 | S * | 12/2013 | Nguyen | D2/916 | |
| 2005/0252036 | A1 * | 11/2005 | Laska | A43B 3/102 | 36/11.5 |
| 2006/0254085 | A1 * | 11/2006 | Mollicone | A43B 3/10 | 36/11.5 |
| 2008/0022558 | A1 * | 1/2008 | Kaufer | A43B 3/0031 | 36/100 |
| 2012/0304499 | A1 | 12/2012 | Kiesel | | |
| 2015/0250264 | A1 * | 9/2015 | Hollander | A43B 23/25 | 2/245 |
| 2016/0015117 | A1 * | 1/2016 | Kizer | A43B 3/122 | 36/11.5 |

* cited by examiner

*Primary Examiner* — Jila M Mohandesi
(74) *Attorney, Agent, or Firm* — Dean Craine

(57) ABSTRACT

Wrapped footwear includes a flip-flop which is wrapped in various ways with a strap. In one embodiment the strap is wrapped around both side members of the flip-flop. In another embodiment the strap is wrapped around the toe post and the side members of the flip-flop. And in another embodiment, multiple straps are wrapped around the toe post and the ankle of the wearer.

2 Claims, 14 Drawing Sheets

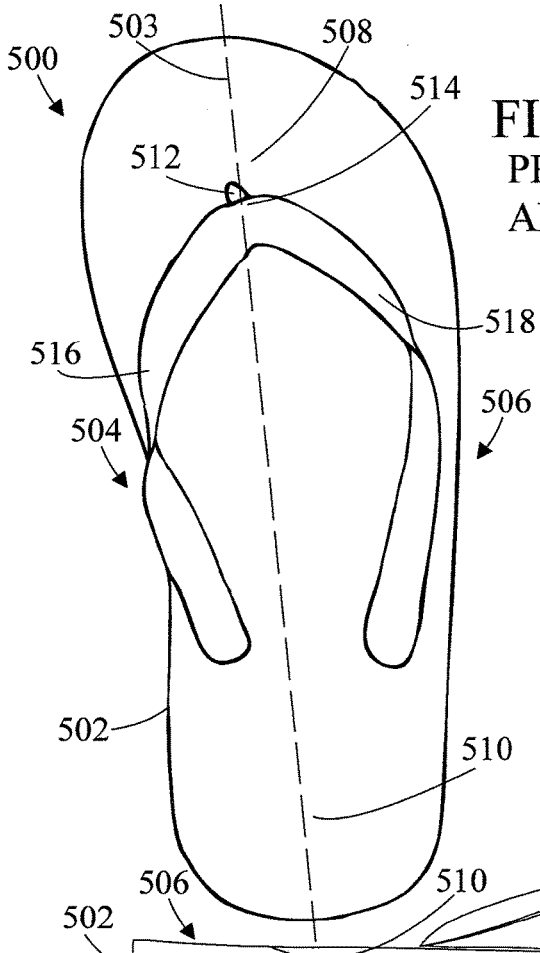
FIG. 1
PRIOR ART
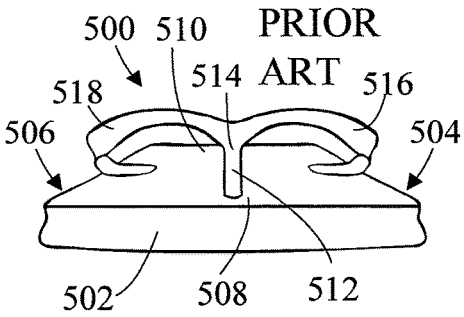
FIG. 3
PRIOR ART
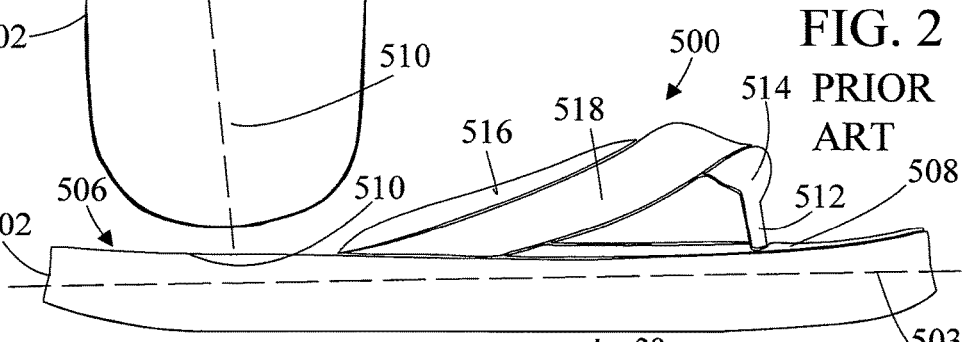
FIG. 2
PRIOR ART
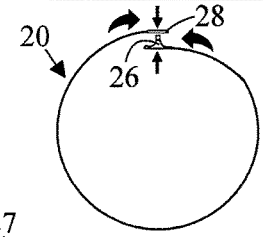
FIG. 7
FIG. 4
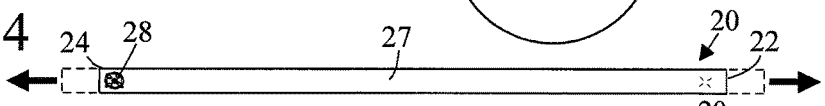
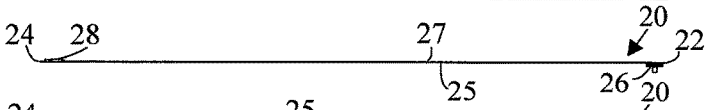
FIG. 5
FIG. 6
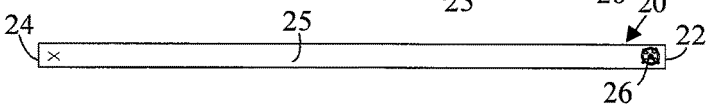

FIG. 20
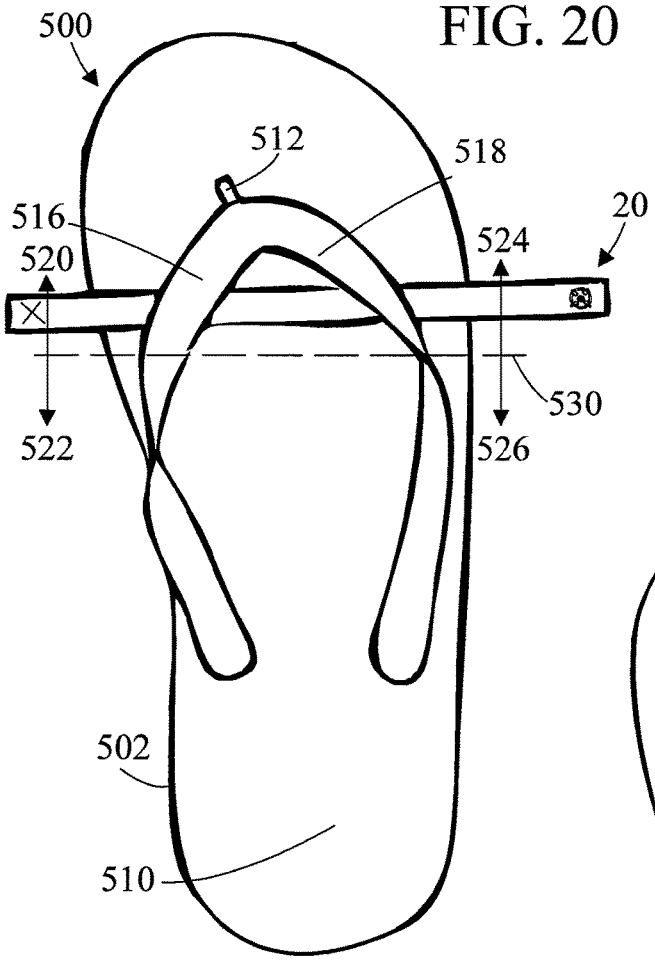
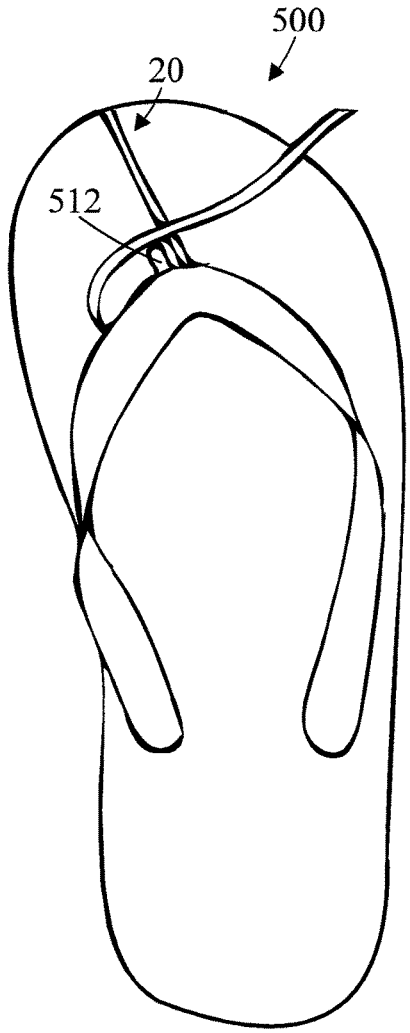
FIG. 21

FIG. 30
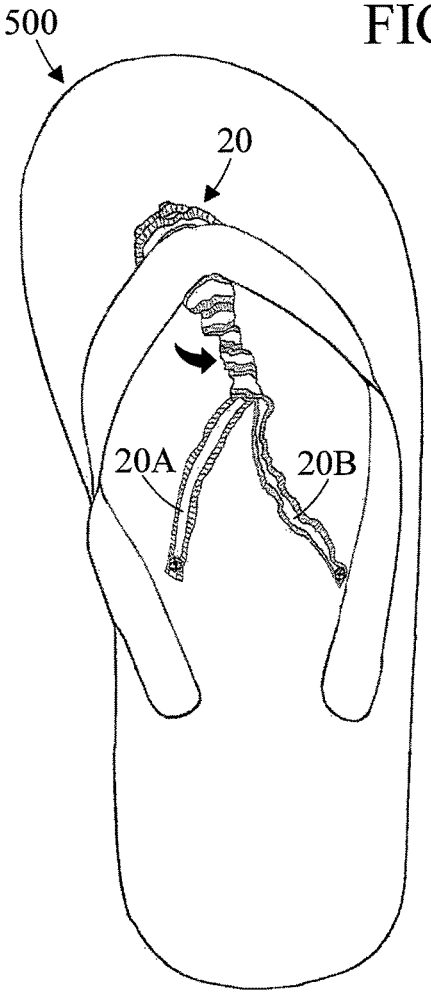
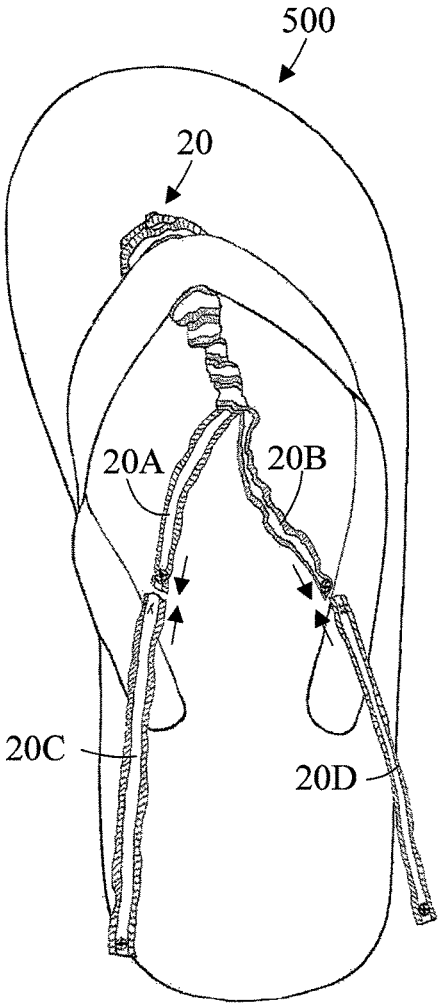
FIG. 31

WRAPPED FOOTWEAR AND METHOD OF WRAPPING

CROSS REFERENCE TO RELATED APPLICATION

This application claims the filing benefit under 35 U.S.C. § 119(e) of U.S. Provisional Application No. 62/115,132, filed Feb. 11, 2015, which is hereby incorporated by reference.

TECHNICAL FIELD

The present invention generally pertains to footwear and the wrapping thereof, and more particularly to footwear which have a toe post connected to two side members.

BACKGROUND OF THE INVENTION

Footwear with a v-strap design, such as sandals, slippers, and primarily flip-flops, have increasingly caused foot and toe pain, strain, fatigue, blisters, plantar fasciitis, and tendonitis due to improper fit and size. Most flip-flops, sandals or v-strap designed shoes have only three points to stabilize the footbed (sole) to the foot. Sometimes these points are too far apart, or out of proportion, in relation to the wearer's foot causing the wearer's foot to slide off of, or around on the footbed. The toe post, placed in the footbed between the first and second toe areas, is a point of contact, for the foot, to secure the flip-flop or sandal to the foot. This requires gripping during most any movement. In order to stabilize the flip-flop or sandal to the foot, the wearer must grip foot and toe muscles around the toe post and into the footbed. When this occurs, the toe post may rub against delicate skin between the toes. If the toe post is too thin, the wearer must grip toe and foot muscles tighter to secure the toe post in order to stabilize the footbed which may result in discomfort, irritated skin or blisters. The v-strap, being a rubber or plastic strap connecting the two side members to the toe post crosses over the top of the foot connecting the toe post and side members of the sandal or flip-flop to the footbed, is sometimes too loose, and if too tight can rub and cause discomfort, skin irritation, or blistering. There is little comfort or resting for feet while wearing loose v-strap designed shoes, flip-flops, slippers, or sandals.

BRIEF SUMMARY OF THE INVENTION

The present invention is directed to wrapped footwear and associated methods for providing a better, more comfortable fit, and/or a tighter fit for v-strap style footwear, reducing toe and foot strain, fatigue or pain. One or more decorative straps are connected together by a hidden securing system to secure loose-fitting footwear such as v-strap style shoes for men, women and children. The strap(s) provide fashionable, personalized, better fitting, and more comfortable footwear which can reduce foot fatigue and pain. The strap(s) may include a variety of elastic limits, colors, logos, sports logos, team colors, symbols, textures, patterns, designs and accent accessories not limited to symbols, beads, gems, jewels, charms and glitters in a variety of shapes and style combinations.

In accordance with a first wrapped footwear embodiment, wrapped footwear includes a flip-flop with a sole having (1) a first side, (2) an opposite second side, (3) a toe end, (4) an opposite heel end, and (5) a longitudinal axis, an upwardly projecting toe post having a top end is connected to the sole at the toe end, a first side member is connected between the top end of the toe post and the first side, and a second side member connected between the top end of the toe post and the second side. A longitudinally elastic strap has a first end and an opposite second end. A first connector is disposed at the first end of the strap, a second connector is disposed at the second end of the strap, the second connector being removably connectable to the first connector. The strap is wrapped at least once around the first side member, and the strap is wrapped at least once around the second side member. The first connector is connected to the second connector, wherein the strap causes the first side member and the second side member to be pulled together.

In accordance with another embodiment, the strap is wrapped around the first side member a plurality of times, and the strap is wrapped around the second side member a plurality of times.

In accordance with another embodiment, the strap has a first side and an opposite second side. The first connector is disposed on the first side of the strap at the first end, and the second connector is disposed on the second side of the strap at the second end.

In accordance with another embodiment, the strap has a first part disposed adjacent to the first end and a second part disposed adjacent to the second end. The first part is wrapped around the first side member, and the second part is wrapped around the second side member.

In accordance with another embodiment, after wrapping the strap is positionable along the longitudinal axis of the flip-flop.

In accordance with a second wrapped footwear embodiment, the first side member has a proximal section adjacent to the toe post and a distal section extending toward the heel end of the sole, and the second side member has a proximal section adjacent to the toe post and a distal section extending toward the heel end of the sole. The strap is wrapped at least once around the toe post. The strap is also wrapped at least once around the proximal section of the first side member but not around the distal section of the first side member. The strap is wrapped at least once around the proximal section of the second side member but not around the distal section of the second side member. The first connector is connected to the second connector.

In accordance with another embodiment, the strap is wrapped around the toe post a plurality of times, the strap is wrapped around the proximal section of the first side member a plurality of times, and the strap is wrapped around the proximal section of the second side member a plurality of times.

In accordance with another embodiment, the strap causes the proximal section of the first side member and the proximal section of the second side member to be pulled together.

In accordance with a third wrapped footwear embodiment, the wrapped footwear is worn by a wearer having a foot and an ankle having a first side, an opposite second side, and a posterior area. The strap is wrapped at least once around the toe post. A second strap is connected to the first end of the strap. A third strap is connected to the second end of the strap. A fourth strap is connected to the second strap. A fifth strap is connected to the third strap. The fourth strap is positioned at the first side of the ankle. The fifth strap is positioned at the second side of the ankle. The fourth strap is connected to the fifth strap at the posterior area of the ankle.

In accordance with another embodiment, the strap is wrapped around the toe post a plurality of times.

In accordance with another embodiment, the second and third straps are twisted together.

Other embodiments, in addition to the embodiments enumerated above, will become apparent from the following detailed description, taken in conjunction with the accompanying drawings, which illustrate, by way of example, the principles of the wrapped footwear and method.

BRIEF DESCRIPTION OF THE DRAWINGS

FIG. 1 is a top plan view of a prior art flip-flop;

FIG. 2 is a side elevation view of the flip-flop;

FIG. 3 is a front elevation view of the flip-flop;

FIG. 4 is a top plan view of a strap;

FIG. 5 is a side elevation view of the strap;

FIG. 6 a bottom plan view of the strap;

FIG. 7 is a side elevation view of the strap being connected to itself;

FIGS. 20 through 24 show top plan views of a second process for wrapping the flip-flop;

FIGS. 26-31 show top plan views of a third process for wrapping a flip-flop; and, FIGS. 32-34 show side perspective views of the third process for wrapping a flip-flop.

DETAILED DESCRIPTION OF THE INVENTION

Figure 8:
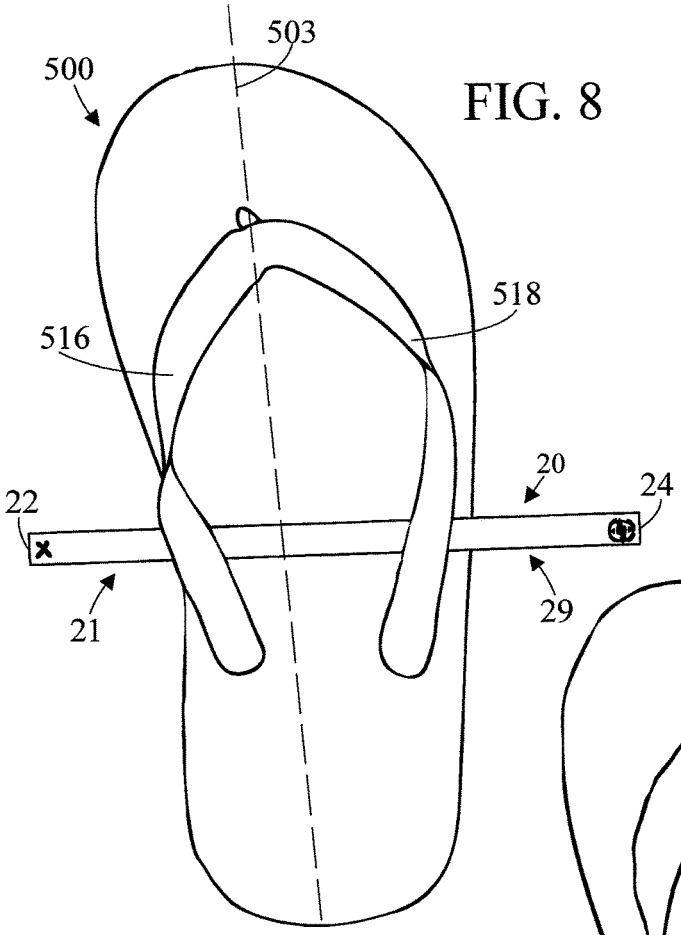
FIGS. 8 through 13 show top plan views of a process for wrapping the sides of the flip-flop.
Figure 9:
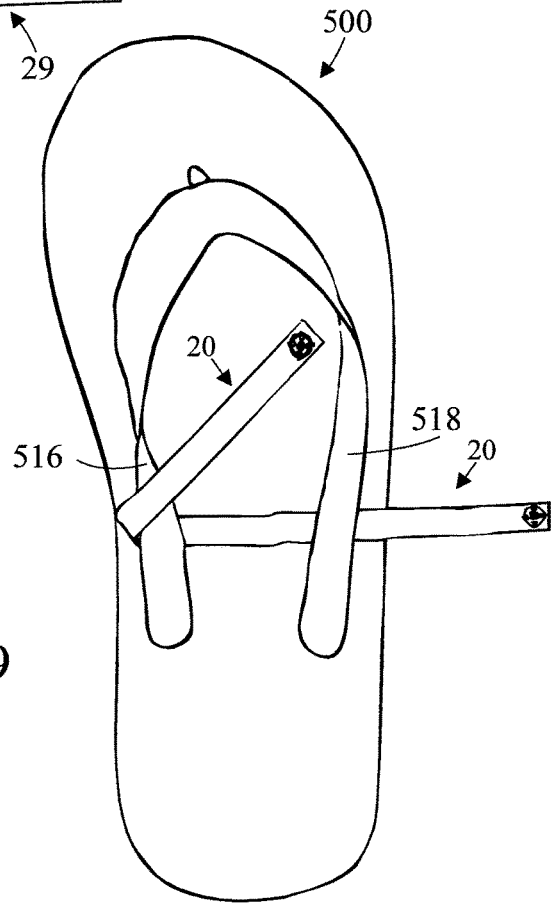
Figure 10:
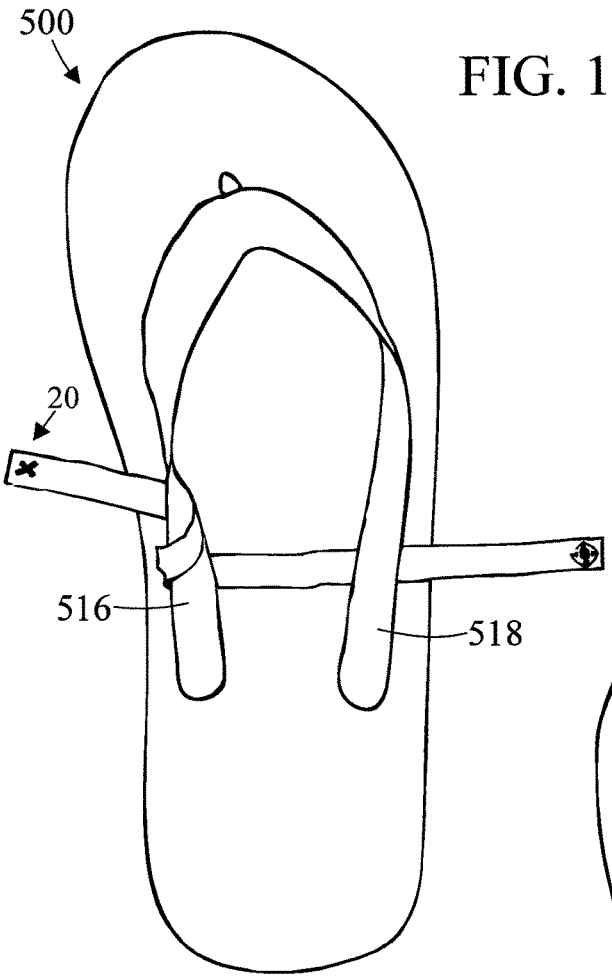

Referring initially to FIGS. 1-3, there are illustrated top plan, side elevation, and front elevation view respectively of a prior art flip-flop generally designated as 500. Flip-flop 500 is an open casual form of footwear which includes a sole 502 which has (1) a first side 504, (2) an opposite second side 506, (3) a toe end 508, (4) a heel end 510, and (5) a longitudinal axis 503. An upwardly projecting toe post 512 (also known as a thong) having a top end 514 is connected to sole 502 at toe end 508. A first side member 516 (strap) is connected between top end 514 of toe post 512 and first side 504, and a second side member 518 (strap) is connected between top end 514 of toe post 512 and second side 506.

Figure 14:
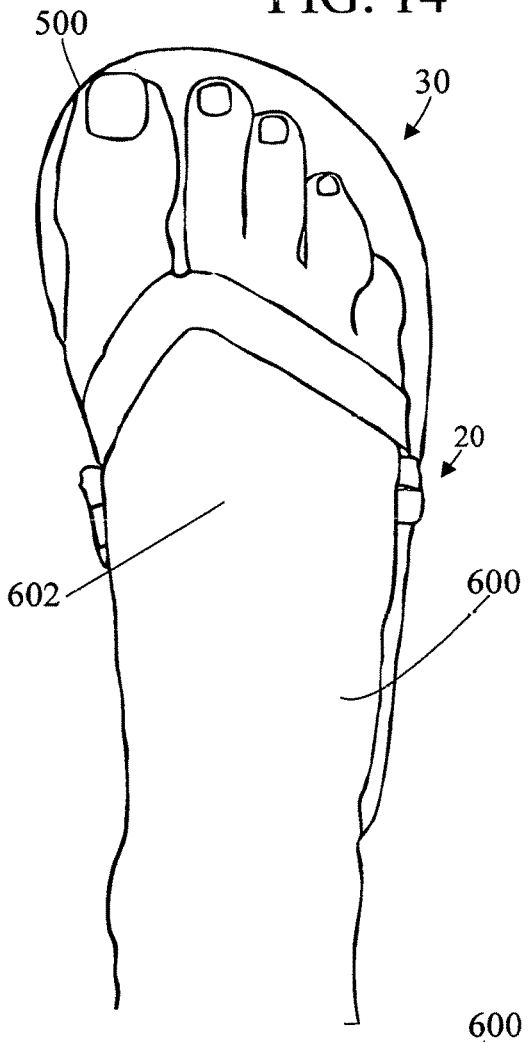
FIG. 14 is a top plan view of wrapped footwear with the sides wrapped and being worn by a wearer.
Figure 15:
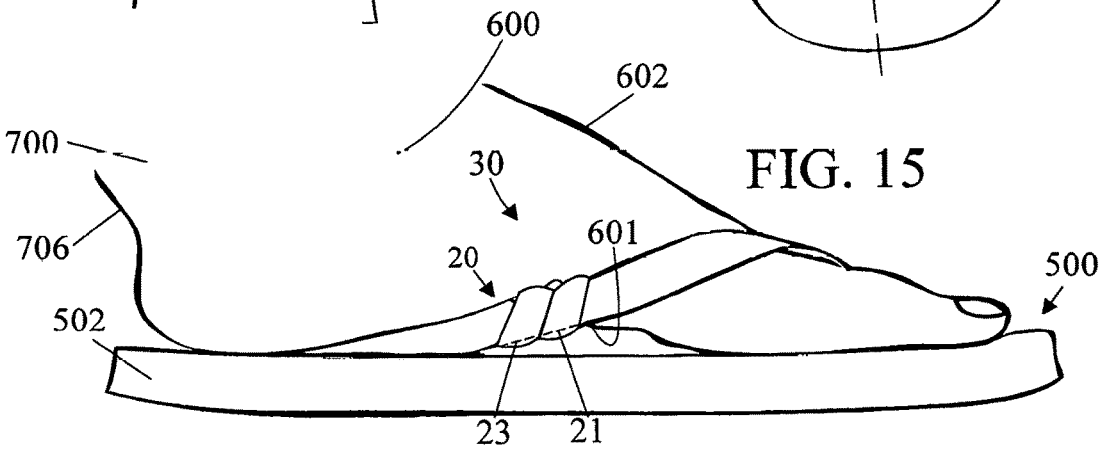
FIG. 15 is a side elevation view of wrapped footwear with the sides wrapped and being worn by a wearer.

A wearer places a foot in flip-flop 500 such that the gap between the big and second toes receives toe post 512, and side members 516 and 518 abut the sides of the foot (refer to FIGS. 14 and 15). Flip-flops are typically fabricated from rubber or a polymer. As used herein the term "flip-flop" 500 includes any form of footwear (including sandals) which has a toe post 512 which is received by the gap between the big and second toes, and two side members 516 and 518 which are connected between the top of the toe post 512 and the sides 504 and 506 of the sole 502.

FIGS. 4-6 are top plan, side elevation, and bottom plan views respectively of a strap generally designated as 20. FIG. 7 is a side elevation view of strap 20 being connected to itself. Strap 20 has a first end 22 and an opposite second end 24. A first connector 26 is disposed at first end 22 of strap 20, and a second connector 28 is disposed a second end 24 of strap 20. Second connector 28 is removably connectable to first connector 26 so that ends 22 and 24 can be removably connected together as shown in FIG. 7. First 26 and second 28 connectors can be any type of mating connectors, such as snaps, hooks, clips, hook-and-loop fasteners, or the like. In the shown embodiment mating male and female snaps are utilized. It is noted that to form the closed connected configuration of FIG. 7, the first 26 and second 28 connectors must be on opposites sides of strap 20.

In the shown embodiment, strap 20 has a first side 25 and an opposite second side 27. First connector 26 is disposed on first side 25 of strap 20 at first end 22, and second connector 28 is disposed on second side 27 of strap 20 at second end 24. Also in an embodiment, strap 20 is fiber thread such as cotton, polyester, or nylon, which is braided, knitted or woven with rubber.

In FIG. 7 it is noted that when the first 26 and second 28 connectors are connected, they are generally hidden from view. In an embodiment, strap 20 is about 7 to about 12 inches in length, and 0.75 inches wide. Also, as shown in FIG. 4, strap 20 is longitudinally elastic so that it can be stretched lengthwise and when released will return to its original length (refer to FIG. 4).

FIGS. 8 through 13 show top plan views of a process for wrapping the sides of flip-flop 500. In FIG. 8 strap 20 is placed between (1) first 516 and second 518 side members, and (2) sole 502 of flip-flop 500 so that it is approximately perpendicular to longitudinal axis 503. Then in FIG. 9, strap 20 is wrapped at least once around first side member 516. As used herein the term "wrapped around" or "wrapping around" means that strap 20 starts on the near side of an object (e.g. a side member or toe post), loops around the opposite (far) side of the object, and then returns to the near side of the object. Put another way, wrapping strap 20 half way (as opposed to completely encircling) constitutes wrapping around. Or stating the wrapping a different way, first side member 516 (or second side member 518, or toe post 512) is wrapped with strap 20. According to the above definition, in FIG. 9 strap 20 is wrapped once around first side member 516.

It is noted in FIG. 8 that strap 20 has a first part 21 disposed adjacent to first end 22 and a second part 29 disposed adjacent to second end 24. First part 21 is wrapped around first side member 516, and second part 29 is wrapped around second side member 518 (refer to FIG. 11).

In FIG. 10 strap 20 is again wrapped around first side member 516, so that strap 20 has now been wrapped a plurality of times (twice as shown) around first side member 516.

Figure 11:
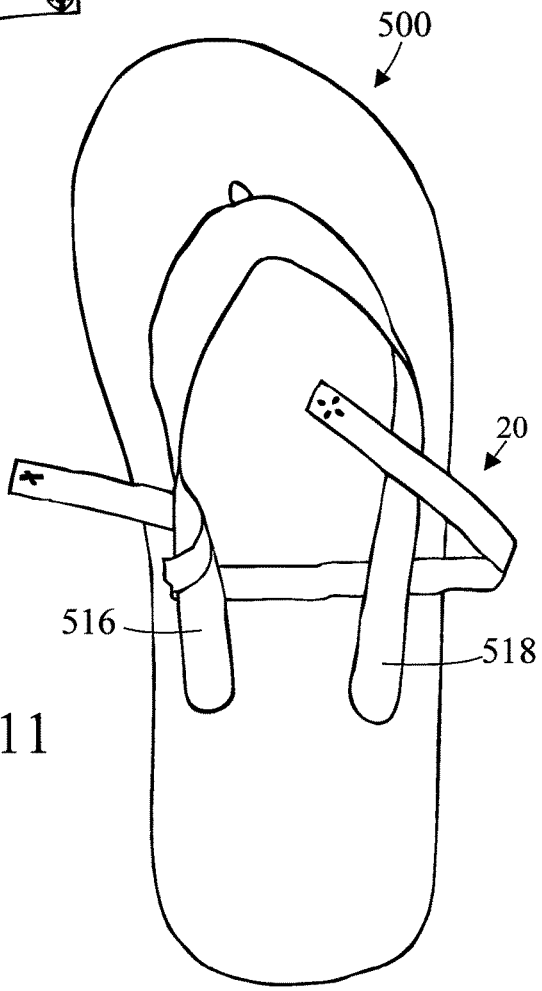

In FIG. 11 strap 20 is wrapped at least once around second side member 518, and in FIG. 12 strap 20 is again wrapped around second side member 518, so that strap 20 has now been wrapped a plurality of times (twice as shown) around second side member 518.

Figure 12:
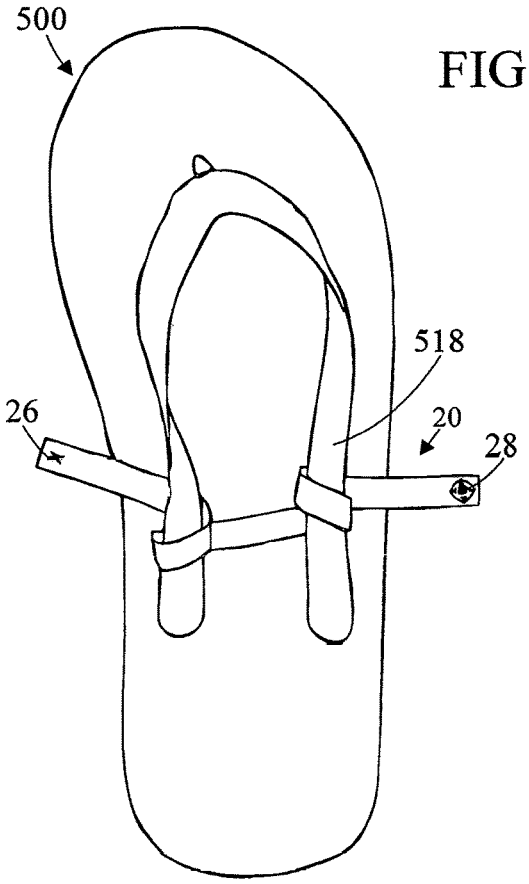
Figure 13:
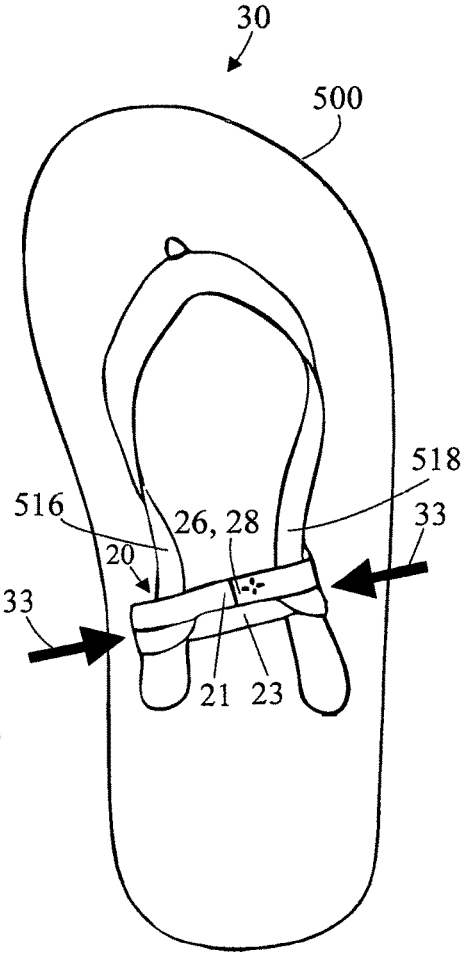

In FIG. 13 first connector 26 is connected to second connector 28 (also refer to FIG. 12). Because strap 20 is longitudinally elastic, during the wrapping process it becomes longitudinally stretched. As such, when first connector 26 is connected to second connector 28 strap longitudinally contracts and causes first side member 516 and second side member 518 to be pulled together (biased) in the direction of arrows 33. It is noted in FIGS. 8-13 that strap 20 is wrapped around the outside edges (the edges facing away from longitudinal axis 503) of side members 516 and 518. This is so when the ends of strap 20 are connected strap 20 will pull side members 516 and 518 together. In this configuration strap 20 has been wrapped three times around first side member 516 and three times around second side member 518. It is noted that because first connector 26 and second connector 28 are on opposite sides of strap 20, when they are connected the connectors are hidden from view.

It may be appreciated that the wrapping of side members 516 and 518 could include other wrapping configurations. For example, strap 20 could be more loosely or tightly wrapped around the side members, could be wrapped less or more times around the side members, could be wrapped in different ways around the side members etc., all of which are intended to be embraced within the scope of the appended claims.

FIGS. 14 and 15 are top plan and side elevation views respectively of wrapped footwear 30 with strap 20 being worn by the foot 600 of a wearer.

Figure 16:
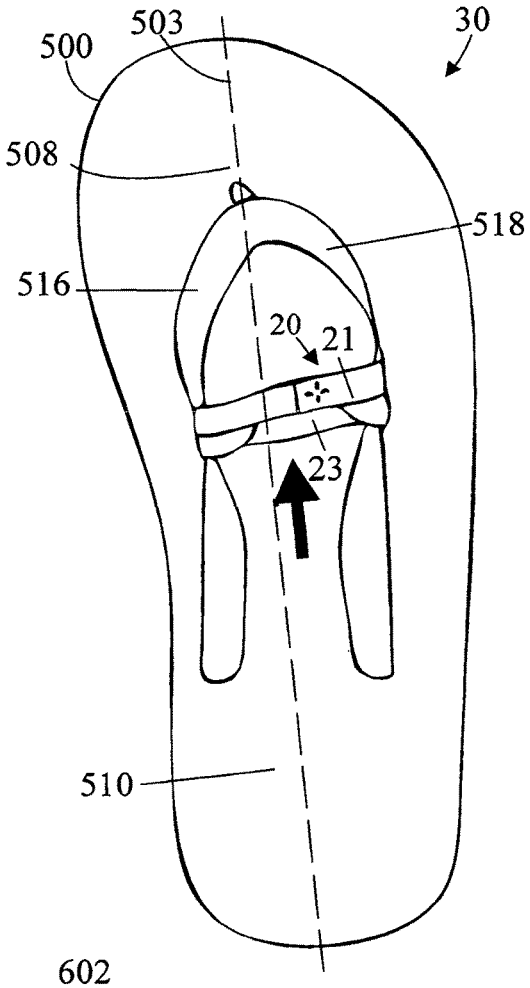
FIG. 16 is a top plan view showing the strap moved to a different location.

FIG. 16 is a top plan view showing strap 20 moved to a different location. After wrapping strap 20 can be positioned to a desired location along longitudinal axis 503 (and along first side member 516 and second side member 518) of flip-flop 500 to adjust the fit of flip-flop 500. As shown strap 500 has been moved, from the position of FIG. 13, toward toe end 508 of flip-flop 500 which will result in flip-flop 500 being tighter on the foot 600 of the wearer. Similarly, moving strap 20 toward the heel end 510 of flip-flop 500 will result in flip-flop 500 being looser on the foot 600 of the wearer.

In FIGS. 13-16 it is noted that foot 600 of the wearer has a bottom 601. After wrapping, strap 20 has two segments 21 and 23 which extend from first side member 516 to second side member 518. When wrapped footwear 30 is worn, segments 21 and 23 reside between the bottom 601 of the wearer's foot 600 and the sole 502 of flip-flop 500.

Figure 32:
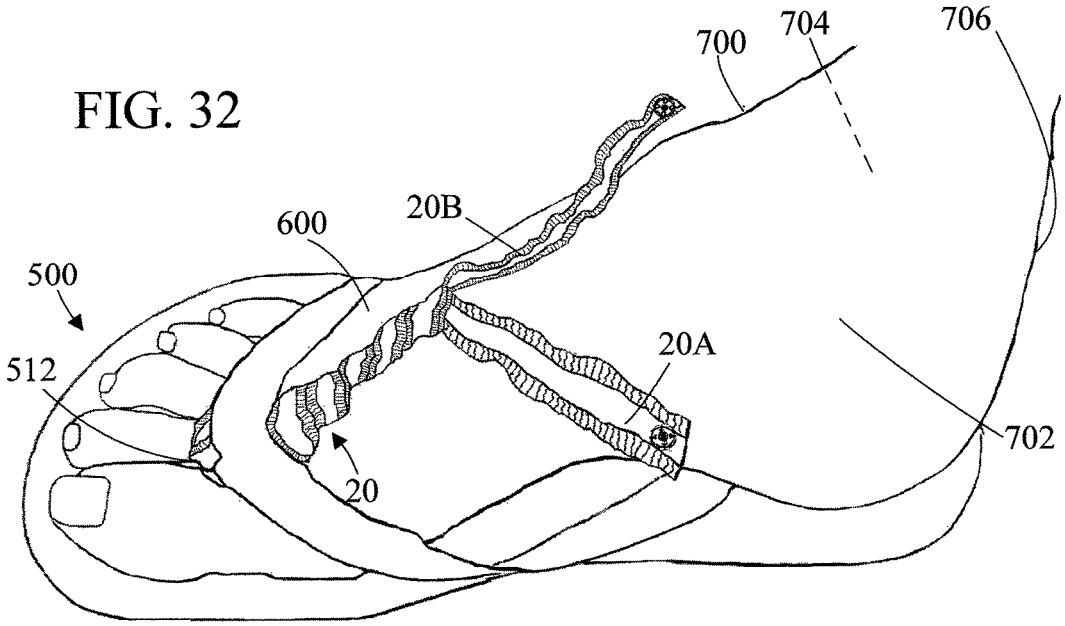

In FIG. 15 is noted that the wearer has an ankle 700 which has a posterior area 706 (also refer to FIG. 32). Strap 20 is not configured to wrap around the posterior area 706 of the ankle 700 of the wearer. In FIGS. 14 and 15, it is further noted that the foot 600 of the wearer has a top area 602. Strap 20 is not configured to contact the top area 602 of the foot 600 of the wearer.

Figure 17:
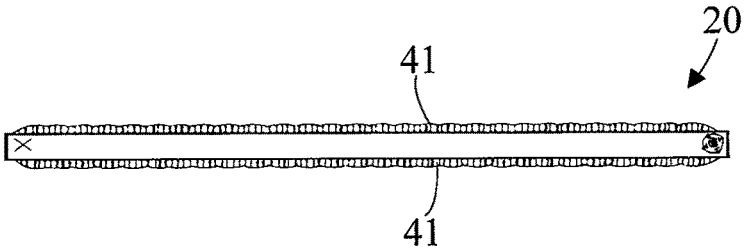
FIG. 17. is a top plan view of a second embodiment strap.

FIG. 17. is a top plan view of a second embodiment strap 20. In this embodiment strap 20 includes ornamental ruffles 41 along its edges. The ruffles 41 provide more cushioning for the wearer without adding bulk, and also provide additional grip thereby reducing slippage of strap 20. It may also be appreciated that strap 20 can be of different colors, patterns, different sizes and shapes, etc. to suit the needs of the wearer.

Figure 18:
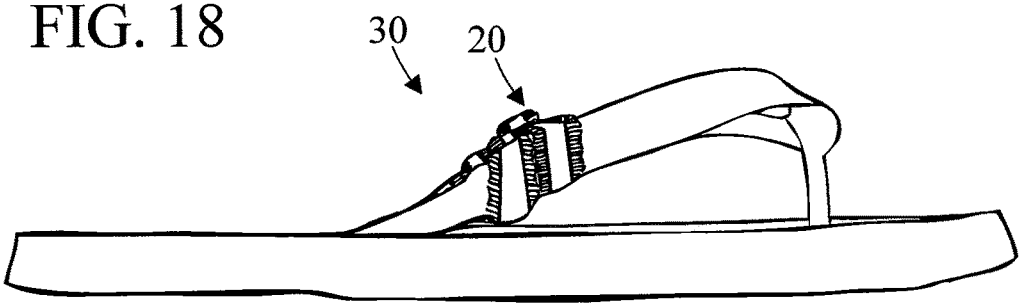
FIG. 18 is a side elevation view of the wrapped footwear with the second embodiment strap.

FIG. 18 is a side elevation view of wrapped footwear 30 with second embodiment strap 20.

Figure 19:
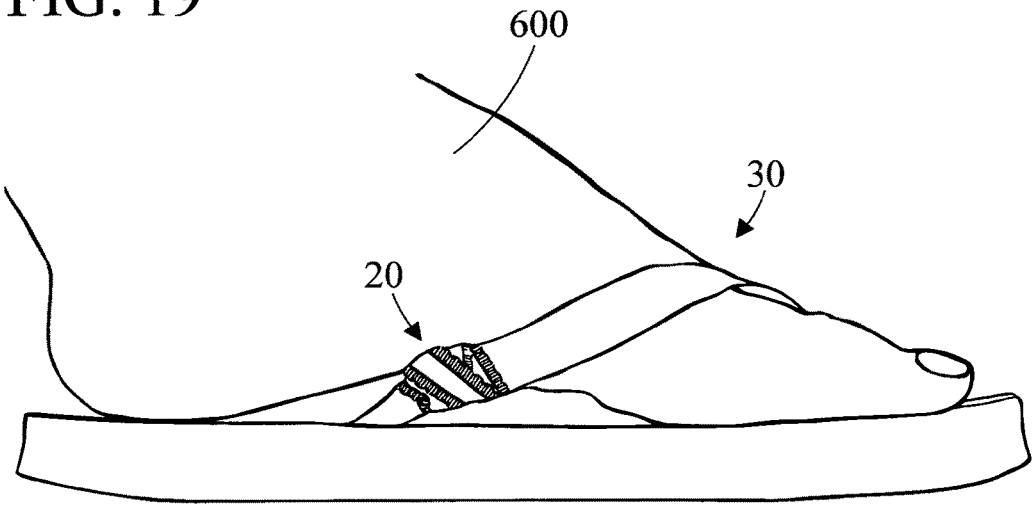
FIG. 19 is a side elevation view as in FIG. 18 with the wrapped footwear being worn by a wearer.
Figure 22:
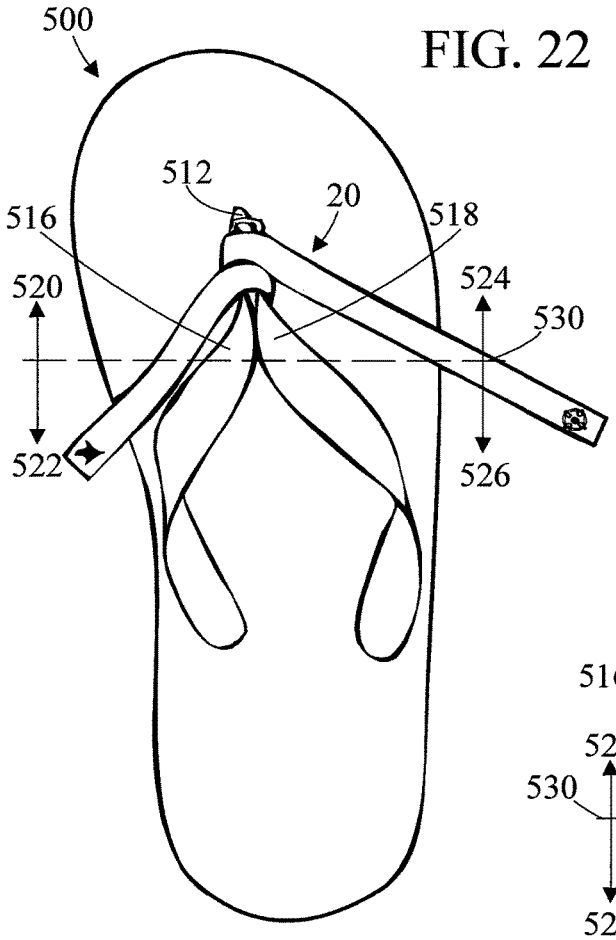

FIG. 19 is a side elevation view as in FIG. 18 with wrapped footwear 30 being worn by the foot 600 of a wearer. It is noted that strap 20 is generally disposed so that it is received by the arch of the wearer's foot 600.

In terms of use, a method for wrapping and wearing footwear, the footwear worn on the foot 600 of a wearer, the foot 600 of the wearer having a bottom 601, includes (refer to FIGS. 1-19):

(a) providing a flip-flop 500 including a sole 502 having (1) a first side 504, (2) an opposite second side 506, (3) a toe end 508, (4) an opposite heel end 510, and (5) a longitudinal axis 503, an upwardly projecting toe post 512 having a top end 514 is connected to sole 502 at toe end 508, a first side member 516 is connected between top end 514 of toe post 512 and first side 504, and a second side member 518 is connected between top end 514 of toe post 512 and second side member 518;

(b) providing a longitudinally elastic strap 20 having a first end 22 and an opposite second end 24, a first connector 26 disposed at first end 22 of strap 20, a second connector 28 disposed at second end 24 of strap 20, second connector 28 removably connectable to first connector 26;

(c) wrapping strap 20 at least once around first side member 516;

(d) wrapping strap 20 at least once around second side member 518; and, (e) after (c) and (d), connecting first connector 26 to second connector 28, wherein strap 20 causes first side member 516 and second side 518 member to be pulled together;

(f) after (e), the strap 20 having two segments 21 and 23 which extend from the first side member 516 to the second side member 518;

(g) placing the wearer's foot on the sole 502 of the flip-flop 500; and, (h) after (a), the two segments 21 and 23 residing between the bottom 601 of the wearer's foot 600 and the sole 502 of the flip-flop 500.

The method further including:

in (c) wrapping strap 20 around first side member 516 a plurality of times; and, in (d) wrapping strap 20 around second side member 518 a plurality of times.

The wearer having an ankle 700 having a posterior area 706, the method further including:

after (g), strap 20 not wrapped around the posterior area 706 of the ankle 700 of the wearer.

The foot 600 of the wearer having a top area 602, the method further including:

after (g), the strap 20 not contacting the top area 602 of the foot 600 of the wearer.

The method further including;

after (e), positioning strap 20 to a desired location along longitudinal axis 503 of flip-flop 500, the positioning including (1) moving strap 20 toward the toe end 508, or (2) moving the strap 20 toward the heel end 510.

Figure 23:
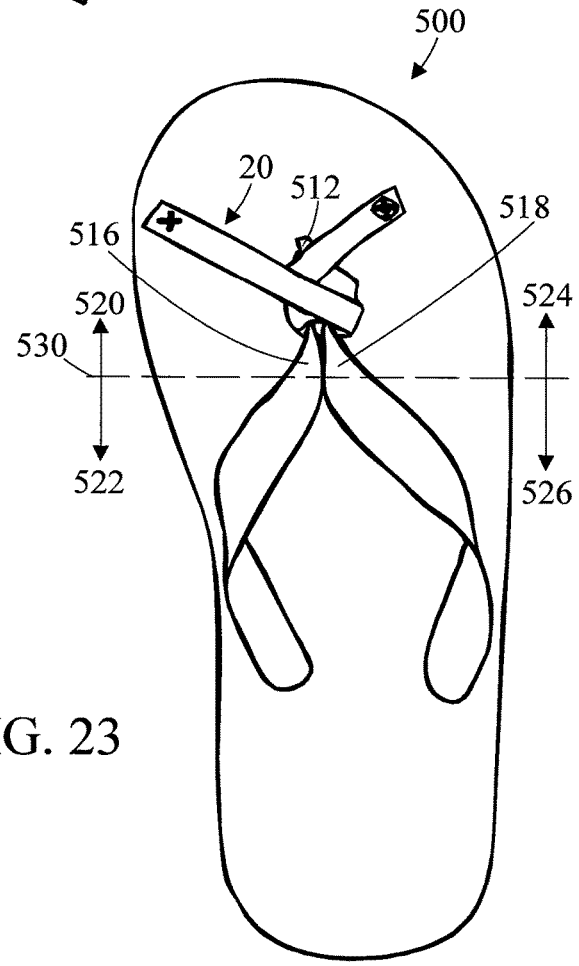
Figure 24:
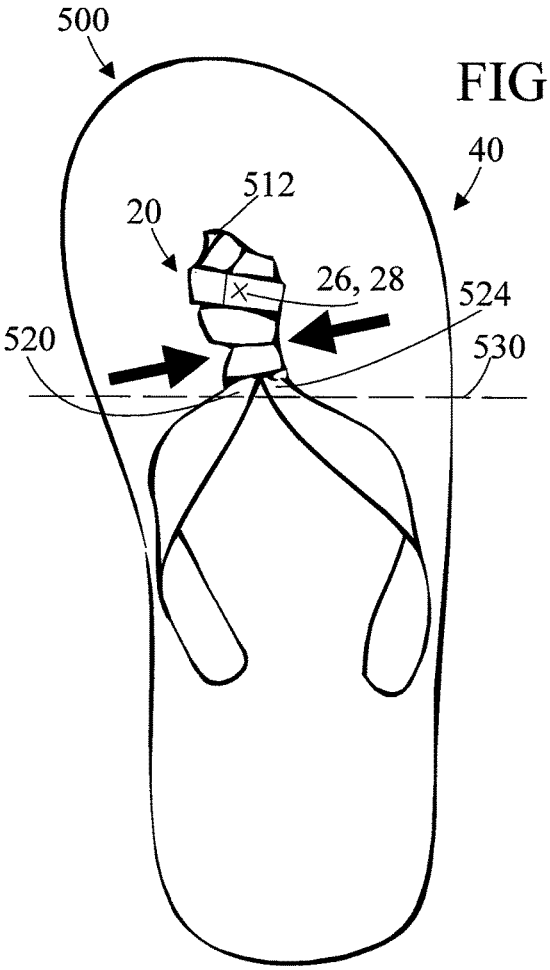
Figure 25:
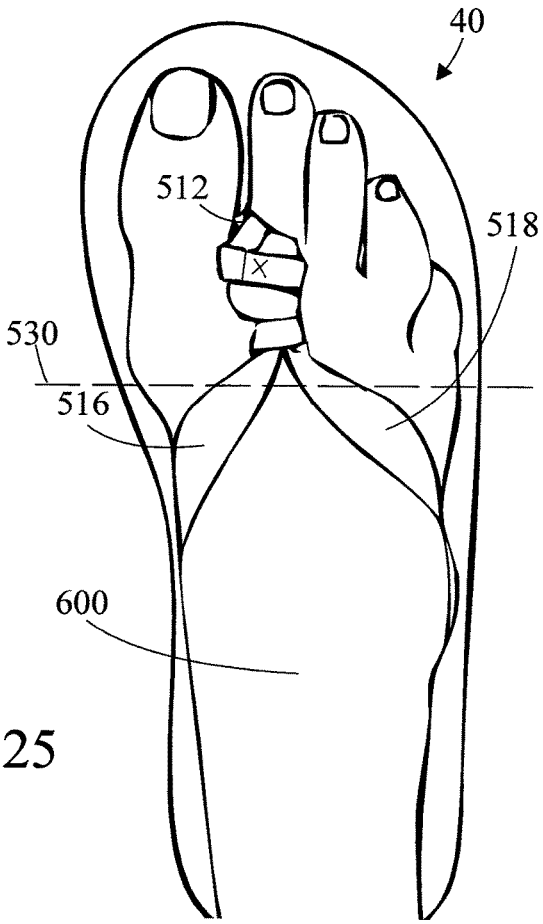
FIG. 25 is a top plan view of wrapped footwear with the toe post and side members wrapped and being worn by a wearer.

FIGS. 20 through 25 show top plan views of a second process for wrapping flip-flop 500. It is noted in FIG. 20 that first side member 516 has a proximal section 520 which is adjacent to toe post 512, and a distal section 522 which extends toward heel end 510 of sole 502. Similarly, second side member 518 has a proximal section 524 which is adjacent to toe post 512, and a distal section 526 which extends toward heel end 510 of sole 502. As shown, the proximal and distal sections of the side members are separated by dashed line 530. In FIG. 20 strap 20 is placed between (1) first 516 and second 518 side members, and (2) sole 502 of flip-flop 500. Then in FIG. 21, strap 20 is wrapped at least once around toe post 512. Then in FIG. 22, strap 20 is wrapped at least once around proximal section 520 of first side member 516 but not around distal section 522 of first side member 516. Also in FIG. 22, strap 20 is wrapped at least once around proximal section 524 of second side member 518 but not around distal section 526 of second side member 518. In FIG. 23, strap 20 is wrapped a plurality of times around toe post 512 (also refer to FIG. 28), around proximal section 520 of first side member 516, and around proximal section 524 of second side member 518. In FIG. 24 first connector 26 of strap 20 is connected to second connector 28 which results in wrapped footwear 40. FIG. 25 is a top plan view of wrapped footwear 40 with the toe post 512 and junction of the side members 516 and 518 wrapped and being worn by the foot 600 of a wearer. In FIGS. 23 and 24 it is noted that in this embodiment the wrapping does not extend to the distal sections of the side members as indicated by dashed line 530. It is also noted in FIG. 24 that strap 20 causes proximal section 520 of first side member 516 and proximal section 524 of second side member 518 to be pulled together into abutting relationship. This provides a more secure fit as well as a more comfortable toe post 512. In this embodiment, the wearer determines how many wraps around toe post 512 and side members 516 and 518 are desired to provide the proper look and feel. In FIG. 15 is noted that the wearer has an ankle 700 which has a posterior area 706 (also refer to FIG. 32). In FIGS. 24 and 25 it is noted that strap 20 is not configured to wrap around the posterior area 706 of the ankle 700 of the wearer.

In terms of use, a second method for wrapping footwear includes (refer to FIGS. 20-25):

(a) providing a flip-flop 500 including a sole 502 having (1) a first side 504, (2) an opposite second side 506, (3) a toe end 508, (4) an opposite heel end 510, and (5) a longitudinal axis 503, an upwardly projecting toe post 512 having a top end 514 is connected to sole 502 at toe end 508, a first side member 516 is connected between top end 514 of toe post 512 and first side 504, first side member 516 having a proximal section 520 adjacent to toe post 512 and a distal section 522 extending toward heel end 510 of sole 502, and a second side member 518 connected between top end 514 of toe post 512 and second side 506, second side member 518 having a proximal section 524 adjacent to toe post 512 and a distal section 526 extending toward heel end 510 of sole 502;

(b) providing a longitudinally elastic strap 20 having a first end 22 and an opposite second end 24, a first connector 28 disposed at first end 22 of strap 20, a second connector 28 disposed at second end 24 of strap 20, second connector 28 removably connectable to first connector 26;

(c) wrapping strap 20 at least once around toe post 512;

(d) wrapping strap 20 at least once around proximal section 520 of first side member 516 but not around distal section 522 of first side member 516;

(e) wrapping strap 20 at least once around proximal section 524 of second side member 518 but not around distal section 526 of second side member 518; and, (f) after (c), (d), and (e), connecting first connector 26 to second connector 28.

The method further including:

in (c), wrapping strap 20 around toe post 512 a plurality of times;

in (d), wrapping strap 20 around proximal section 520 of first side member 516 a plurality of times; and, in (e), wrapping strap 20 around proximal section 524 of second side member 518 a plurality of times.

The method further including:

in (d) and (e), strap 20 causes proximal section 520 of first side member 516 and proximal section 524 of second side member 518 to be pulled together into abutting relationship.

The method further including:

after (f), the wearer wearing the footwear wherein strap 20 is not wrapped around the posterior area 706 of the ankle 700 of the wearer.

Figure 26:
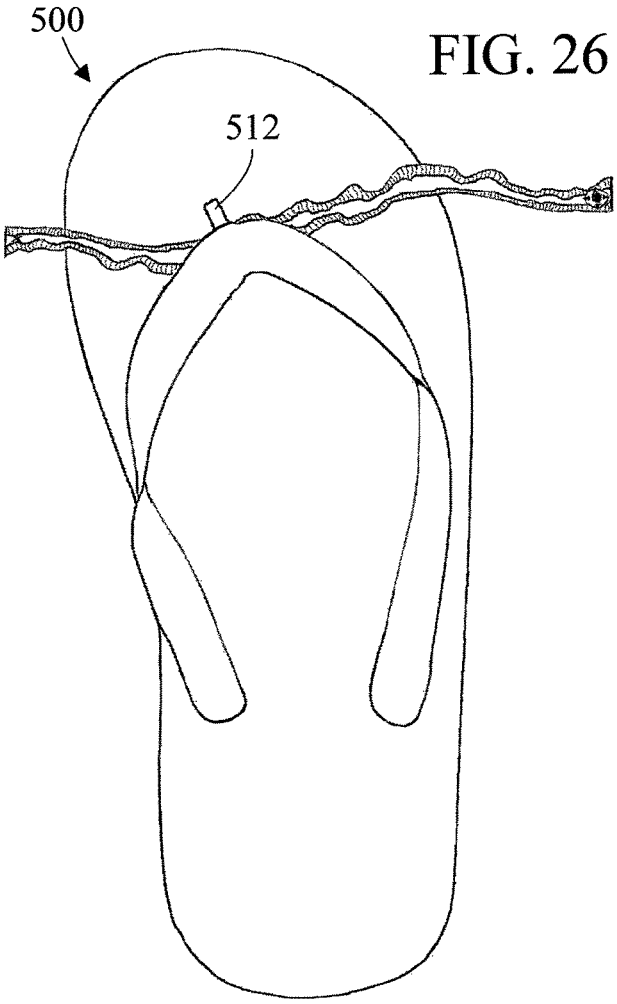
Figure 27:
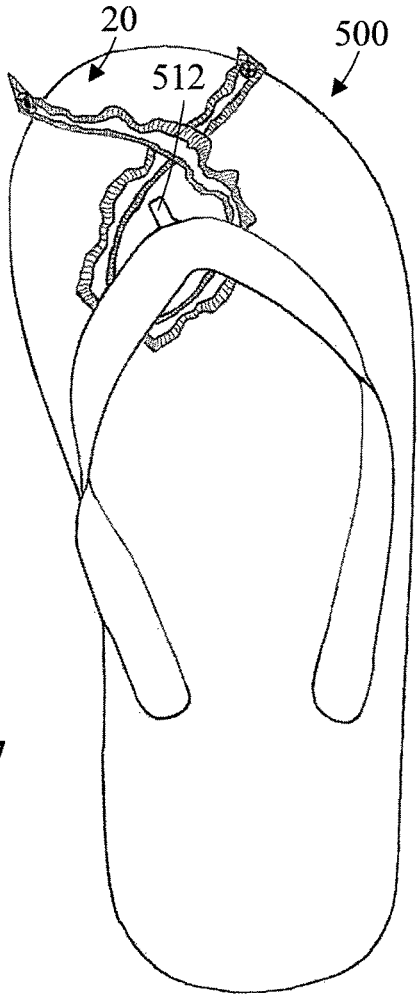
Figure 28:
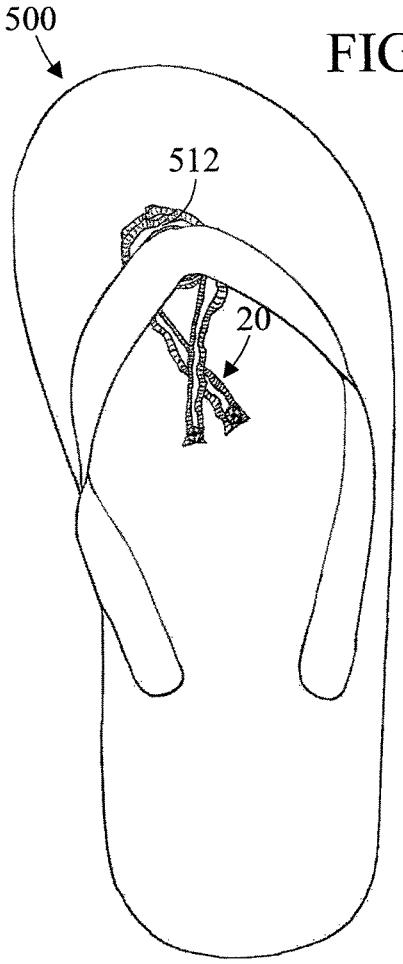
Figure 29:
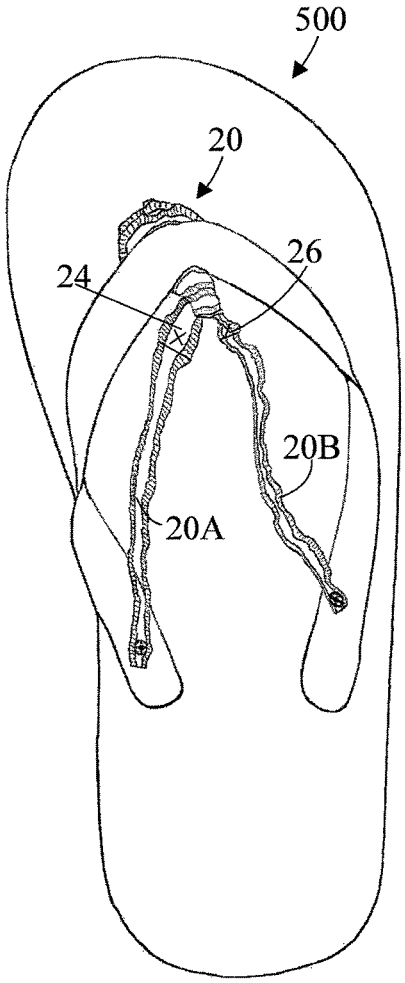
Figure 33:
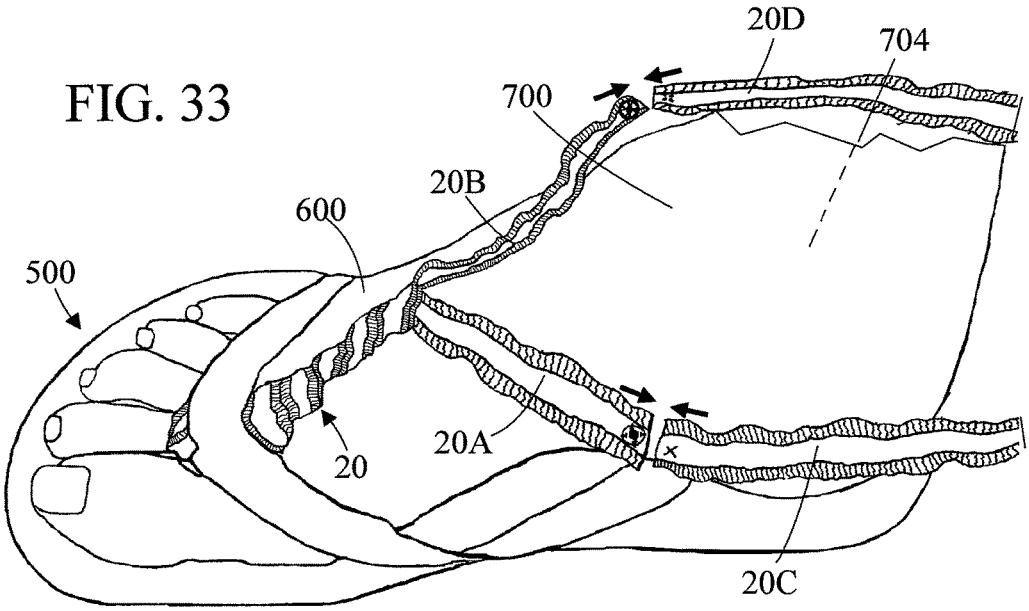
Figure 34:
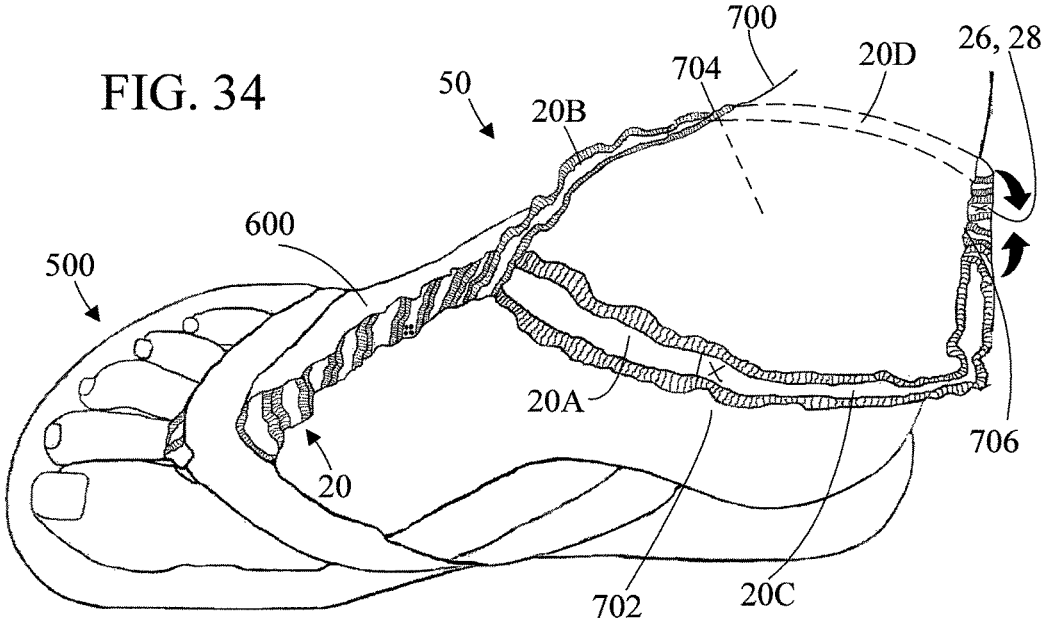

FIGS. 26-31 show top plan views of a third process for wrapping flip-flop 500, and FIGS. 32-34 show side perspective views of the third process for wrapping flip-flop 500. In FIGS. 26-28 strap 20 is wrapped at least once around toe post 512. In the shown embodiment strap 20 is wrapped around toe post 512 a plurality of times. In FIG. 29 a second strap 20A is connected to first end 24 of strap 20, and a third strap 20B is connected to second end 26 of strap 20. The second strap 20A, third strap 20B (and fourth strap 20C and fifth strap 20D. see below) are of similar construction to strap 20 and have mating connectors on opposites ends. In the shown embodiment, in FIG. 30, second strap 20A and third strap 20B are then twisted together.

In FIG. 31 a fourth strap 20C is connected to second strap 20A, and a fifth strap 20C is connected to third strap 20B.

FIG. 32 shows the strap configuration of FIG. 30 with strap 20 wrapped around toe post 512, with second strap 20A and third strap 20B connected to strap 20, and with the wearer's foot 600 placed in flip-flop 500. It is noted that the wearer's foot 600 includes an ankle 700 which has a first side first 702, an opposite second side 704, and a posterior area 706 (at the Achilles tendon).

FIG. 33 shows the strap configuration of FIG. 31 with the wearer's foot 600 placed in flip-flop 500. It is noted that fourth strap 20C is positioned adjacent to first side 702 of ankle 700, and fifth strap 20D is positioned adjacent to second side 704 of ankle 700.

In FIG. 34, fourth strap 20C is connected (by first 26 and second 28 connectors) to fifth strap 20D at the posterior area 706 of ankle 700 to result in wrapped footwear 50. That is, fourth strap 20C and fifth strap 20D now surround ankle 700. The wrapping of FIGS. 26-34 serves to hold the flip-flop 500 more securely on the wearers foot 600. In FIGS. 32-34, it is noted that neither strap 20, second strap 20A, third strap 20B, fourth strap 20C, nor fifth strap 20D are wrapped around first side member 516 (refer to FIG. 1), and neither strap 20, second strap 20A, third strap 20B, fourth strap 20C, nor fifth strap 20D are wrapped around second side member 518 (refer to FIG. 1).

In terms of use, a third method for wrapping footwear which is worn by a wearer having a foot 600 and an ankle 700 having a first side 702, an opposite second side 704, and a posterior area 706, the method includes (refer to FIGS. 26-34):

(a) providing a flip-flop 500 including a sole 502 having (1) a first side 504, (2) an opposite second side 506, (3) a toe end 508, (4) an opposite heel end 510, and (5) a longitudinal axis 503, an upwardly projecting toe post 512 having a top end 514 is connected to sole 502 at toe end 508, a first side member 516 is connected between top end 514 of toe post 512 and first side 504, and a second side member 518 is connected between top end 514 of toe post 512 and second side 506;

(b) providing a longitudinally elastic strap 20 having a first end 22 and an opposite second end 24, a first connector 26 disposed at first end of 22 strap, a second connector 28 disposed at second end 24 of strap, second connector 28 removably connectable to first connector 26;

(c) providing a second strap 20A, a third strap 20B, a fourth strap 20C, and a fifth strap 20D;

(d) wrapping strap 20 at least once around toe post 512;

(e) connecting second strap 20A to first end 22 of strap 20;

(f) connecting third strap 20B to second end 24 of strap 20;

(g) connecting fourth strap 20C to second strap 20A;

(h) connecting fifth strap 20D to third strap 20B;

(i) positioning fourth strap 20C at first side 702 of ankle 700;

(j) positioning fifth strap 20D at second side 704 of ankle 700;

(k) connecting fourth strap 20C to fifth strap 20D at the posterior area 706 of ankle 700; and, after (k), neither strap 20, second strap 20A, third strap 20B, fourth strap 20C, nor fifth strap 20D wrapped around first side member 516, and neither strap 20, second strap 20A, third strap 20B, fourth strap 20C, nor fifth strap 20D wrapped around second side member 518.

The method further including:

in (d), wrapping strap 20 around toe post 512 a plurality of times.

The method further including:

after (e) and (f) and before (g) and (h), twisting second 20A and third 20B straps together.

The embodiments of the wrapped footwear and method described herein are exemplary and numerous modifications, combinations, variations, and rearrangements can be readily envisioned to achieve an equivalent result, all of which are intended to be embraced within the scope of the appended claims. Further, nothing in the above-provided discussions of the wrapped footwear and method should be construed as limiting the invention to a particular embodiment or combination of embodiments. The scope of the invention is defined by the appended claims.

I claim:

1. User adjustable footwear, comprising:

a flip-flop consisting of a sole with a top surface, a bottom surface, a first side, a second side opposite said first side, a toe end, a heel end opposite said toe end, and a longitudinal axis;

an upwardly projecting toe post extending upward from said top surface;

a first side member connected at one end to said sole adjacent to said first side, said first side member extends inward above said top surface and coupled to said toe post;

a second side member connected at one end to said sole adjacent to said second side, said second side member extends inward and above said top surface and coupled to said toe post;

an elongated elastic strap 7 to 12 inches in length that includes a first end and an opposite second end and a center section extending between said first end and said second end, said elastic strap being sufficient in length so that when said center section of said elastic strap is extended transversely over said top surface of said sole and between said first side member and said second side member, said first end and said second end selectively wrapped around said first side member and said second side member, respectively, and said first end and said second end is then extended transversely over said sole and overlapped thereby supporting a medial arch on a user's foot when placed over said top surface of said sole;

a first connector attached at said first end of said elastic strap; and a second connector attached at said second end of said elastic strap, said second connector configured to selectively attach to said first connector thereby selectively connecting said first end and said second end of said elastic strap together when said first end and said second end overlap.

2. A method for conforming a flip flop to a user's foot, wherein the flip flop includes a sole with a first side, a second side opposite said first side, a top surface, a toe end, a heel end opposite said toe end, an upwardly projecting toe post, a first side member connected to said first side of said sole and extending inward and coupled to said toe post, and a second side member connected to said second side of said sole and extending inward and coupled to said toe post, the method comprising:

(a) selecting a flat elastic strap 7 to 12 inches in length and approximately 0.75 inches in width, said elastic strap includes a first end, a second end opposite said first end, and a center section extending between said first end and said second end, said elastic strap includes a first connector attached to said first end and a second connector attached to said second end, said first end connector and said second connector configured to be selectively connected, said elastic strap is made of material sufficiently flexible and sufficient in length enabling said center region to be transversely aligned over said top surface of said sole and between said first side member and said second side member and enabling said first end of said elastic strap and said second end of said elastic strap to be selectively wrapped around said first side member and said second side member, respectively, and then transversely aligned over said sole and under an medial arch of a user's foot when placed over said sole and overlapped to connect said first connector and said second connector, respectively;

(b) said elastic strap is then attached to said flip flop in one of the two following methods:

(i) extending said elastic strap over said top surface of said sole so that said center section of said elastic strap extends transversely between said first side member and said second side member and over said top surface of said sole, said first end and said second end of said elastic strap are then repeatingly wrapped around said first side member and said second side member, respectively, said first end and said second end are then extended transversely over said sole and above said center section and overlap so that said first end connector and said second end connector may be interconnected and thereby forming an arch support that supports the arch of a user's foot when placed on said top surface sole of said flip flop; or (ii) extending said elastic strap transversely over said sole near said toe post and wrapping said center region of said elastic strap around said toe post and repeatingly wrapping said first end and said second end of said elastic strap around sections of said first side member and said second side member, adjacent to said toe post thereby pulling said first side member and said second side member together, said first end connector and said second end connector are then interconnected.

* * * * *